United States Patent [19]

Tunderman

[11] 4,229,962

[45] Oct. 28, 1980

[54] METHOD FOR RECONDITIONING RIVETLESS CHAIN LINKS

[76] Inventor: William Tunderman, 18529 First Ave. - P.O. Box 65, Barstow, Ill. 61236

[21] Appl. No.: 46,770

[22] Filed: Jun. 8, 1979

[51] Int. Cl.[3] ..... B21L 15/00

[52] U.S. Cl. ..... 72/342; 72/401; 29/402.21; 59/30

[58] Field of Search ..... 72/342, 354, 364, 401; 29/402.04, 402.05, 402.19, 402.21; 59/5, 8, 29, 30, 35 R, 35 CP

[56] References Cited

U.S. PATENT DOCUMENTS

| | | | |
|---|---|---|---|
| 1,668,442 | 5/1928 | Wineman | 72/364 |
| 1,714,187 | 5/1929 | Pacy | 29/402.19 |
| 1,848,493 | 3/1932 | Oldacre | 59/30 |
| 2,893,199 | 7/1959 | Sheehan | 59/30 |

FOREIGN PATENT DOCUMENTS

| | | | |
|---|---|---|---|
| 9091 | of 1914 | United Kingdom | 59/29 |

*Primary Examiner*—Lowell A. Larson
*Attorney, Agent, or Firm*—Glenn H. Antrim

[57] ABSTRACT

The pitch of worn chain links is restored to original manufacturers' dimensions by decreasing their overall lengths. Concentrated heat is applied across a selected section at the center area of a link, and force is applied longitudinally to the ends of the link to compress the heated portion. The decrease in length at the heated and compressed section compensates for wear on the inside surfaces of the ends of the links that normally contact the connecting pins.

3 Claims, 3 Drawing Figures

METHOD FOR RECONDITIONING RIVETLESS CHAIN LINKS

BACKGROUND OF THE INVENTION

This invention relates to rivetless chains such as used in overhead trolley conveyors, and particularly to reconditioning worn links of chains by applying concentrated heat and pressure longitudinally to the links.

Overhead trolley conveyors are commonly used in manufacturing assembly lines. Plants for assembling automobiles and farm machinery use such conveyors extensively to carry heavy components and heavy assemblies. The loads are supported on carriers that are suspended from brackets that pass upwardly through center links of chains to trolley wheels supported by overhead track. The center links have the shape of closed, elongated loops and are alternate links of continuous chains that are driven by sprockets or by caterpillar drives to move the loads. The links between the center links are pairs of parallel side links. The adjacent ends of each pair of side links overlap a relatively large end of a center link, and a pin having a T-head at each end has a shank extending through the ends of the side links and through the intermediate end of the central link. The ends of the center links have greater heights than their intermediate portions to facilitate assembly and disassembly and to increase load-bearing surfaces tending to wear.

Driven sprockets enter the chains between pairs of side links and apply successively to one end of each center link a longitudinal force to run the conveyors. The changes in direction of the movement of the chains of the conveyors as required to move loads to different lines of assembly are provided by wheel turns along the tracks. While the chains are guided around wheels, the center links pivot about the pins, the pins being restrained from rotation in the side links by the T-heads within slots in the ends of the side links. The inside surfaces of the ends of the center links and the contiguous portions of the shanks of the pins wear whenever conveyors are operating, and wear is most likely at the turns of the conveyors.

When the chains wear to such an extent that their respective lengths increase more than about three percent, the operation of the chains is impaired because spacings between successive pairs of side links are longer than the distance between successive driving sprockets. Since chains can be reconditioned at small cost compared with the cost of new chains, the chains may be reconditioned and placed back into service. The usual method of reconditioning worn chains comprises disassembling and cleaning the links and replacing pins. Although the replacement of the pins or their rotation through 180 degrees after the chains are first worn decreases the length of the chains sufficiently to restore them for satisfactory and limited extended use, the expensive center links with continued use become worn to such an extent that they must be replaced after the pitch of the worn links no longer match the pitch of the driving sprockets.

SUMMARY OF THE INVENTION

According to the present method, links of chains are compressed to decrease their overall length and thereby to decrease the distance between surfaces in contact with pins sufficiently to compensate for wear. Before a chain is dismantled for reconditioning, it is drawn tightly over a predetermined length, for example 10 feet (3.05 m), and the overall pitch, distance between pins at the ends of the length, is measured. The length specified for a new chain is deducted from this measurement. Since new pins are to be used when the chain is to be reassembled, the increase in length of the chain resulting from worn pins, known from calculation and experience, is also subtracted from the measured length. The remainder is divided by those links to be reconditioned within the measured length to determine the amount by which each link is to be decreased in length to restore the overall length of the chain when the links are joined by new pins. At least all the center links are to be reconditioned, and the amount of change required for each link may be decreased if desired by reconditioning the side links also. After the length of each link is decreased by the calculated amount, the links of the chain are reassembled by use of new pins to obtain the original length and thereby to obtain the original pitch.

After the links are cleaned, each link is placed in a fixture and concentrated heat is applied over a length from about three-fourths inch (19 mm) to 1 inch (25.4 mm) across the middle of the link. The links are commonly forgings fabricated from high carbon steel and then heat treated, and the portions that are heated again can be reformed by force. A preferred method is the use of an induction coil about the middle of the link. After the central section of a link has been heated to a sufficient temperature between 1100 degrees and 1300 degrees F. (593 degrees to 704 degrees C.), the link is immediately transferred to a base that has channels that fit quite tightly along the sides of the link, and then an upper die having similar shaped channels is pressed tightly down over opposite edges of the sides. While the base and the die are being held tightly together, compressing members engage the ends of the link and are moved toward each other to stop at a precise distance apart to restore the pitch of the link by longitudinally compressing the heated portions of the sides. The ends of the compressing members have contours for fitting the ends of the link, and since the link fits tightly within the base and the die, the original shape other than a slight shortening is maintained. The center links can be reconditioned several times until the ends with the bearing surfaces for the pins are too thin to provide the required tensile strength while being loaded normally. The chain is reassembled with both the reconditioned links and new pins to perform like a new chain. After the first reconditioning, the life of the chain until it again needs reconditioned is about the same as the life of a new chain. Since the chain links can be reconditioned at a small fraction of the cost of a new chain, the savings realized by reconditioning chains rather than buying new ones whenever the pitch at first becomes excessive is substantial. Compared with manufacturing new links, iron as a basic material and heat required for both forging and heat treating are saved. Immediately after the links are compressed, the links may be quenched to restore temper, but even if the links are not quenched, the strength of the links have not been decreased detrimentally for most purposes because the heated areas have become slightly greater in cross section to partially compensate for loss of strength due to the loss of temper.

DESCRIPTION OF THE PREFERRED EMBODIMENT

Figure 1:
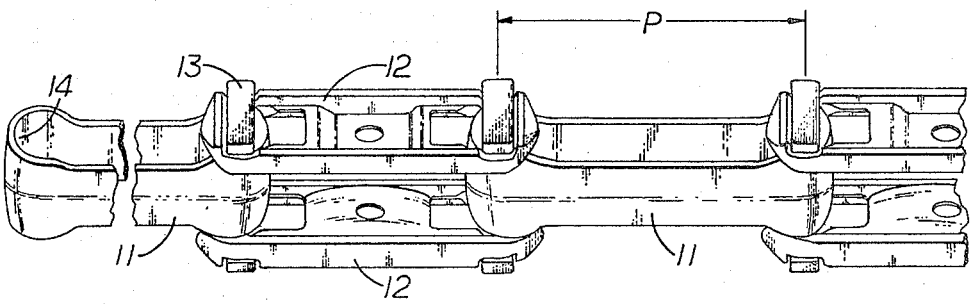
FIG. 1 is a perspective view of a short length of usual chain to be reconditioned.

A typical chain for use in overhead trolley conveyors as shown in FIG. 1 has center links 11 connected to pairs of side links 12 by pins 13. Typically, the center links 11 have the general shape of a loop, the ends of the loops having somewhat greater height than the height of the sides. The side links 12 have near their ends openings through which T-heads of pins 13 can be passed after the heads have been oriented in respective longitudinal directions with respect to the side links. An inner surface of each end of a side link 12 is positioned against an end of a center link 11 and the opposite side of the side link 12 is indented to receive a head of the pin 13 and to hold it in a transverse position. The pitch P of a single link is measured from the center of a pin 13 to the center of a successive pin. In determining wear of a chain, an overall pitch for a specified length of chain may be measured. For example, when the pitch of a single link is 4 inches (10.16 cm), an overall pitch for 30 links may be considered to be 10 feet (3.05 m) for a new chain, and the pitch over that length may be measured for a worn chain to determine the difference that can be contributed to wear.

Since the greatest amount of wear is on the shanks of the pins 13, the pins 13 can be rotated 180 degrees or replaced to extend the use of a chain. However, since the wear at 14 on the inside surface of each end of each of the center links 11 is substantial, the pitch of the chain has not been restored sufficiently such that its service after being put back into operation will be nearly as long as the time between when the chain was new and when it needed its pins replaced. According to the method described in detail below, the lengths of the links 11 are decreased to restore the distance between the inside surfaces 14 of each link to the specified distance for a new link.

Before a worn chain is dismantled, the pitch over a length is measured to determine the amount of wear. The amount of wear to be contributed to wear of the pins 13 can be determined by calculation or is known from previous experience. The remaining wear can then be contributed to wear of the inside surface at 14 of the link 11. Alternately, a sample of the center links 11 may be taken from the chain and the distances between the inside surfaces at 14 of the ends for each length can be measured to determine an average length. This length can then be compared with a specified length between the inside surfaces to determine the amount by which each center link is to be decreased in length.

For example, a conveyor chain regardless of its length may become worn so that its length is equal to or more than an amount that is commonly the maximum amount allowed before replacement. The maximum allowable amount is commonly 3.5 inches (89 mm) for each length of 10 feet (3048 mm), a worn length measuring 123.5 inches (3137 mm) or more. Of this accumulated wear, 1.5 inches (38 mm) might be contributed to wear of the link pins 13, the remainder of the wear of 2 inches (51 mm) contributed to wear of the center links 11 and the side links 12.

Assuming the pitch P of each chain link is 6 inches (152.4 mm), each length of 10 feet (3048 mm) has 20 pins 13, 10 center links 11, and 20 side links 12. By calculation, wear of 1.5 inches (38 mm) is contributed to the pins 13, each pin having two bearing surfaces. Of the remaining wear of 2 inches, wear of 1.0 inch is contributed to wear of the 10 center links 11, and the same amount of 1 inch is contributed to the 20 side links 12. Each of the center links 11 and of the side links 12 also have two bearing surfaces, the surfaces being in contact with the pins. The wear on each bearing surface of each center link 11 is therefore $1/10 \times \frac{1}{2}$ or 0.05 inch (1.27 mm), and the total wear for each center link 11 is 0.10 inch (2.54 mm). To restore the worn chain to its original length, with the pitch for each link being 6 inches (152.4 mm), each of the links 11 and 12 need to be decreased in length by 0.10 inch (2.54 mm). When the length is to be restored by decreasing the length of only the center links 11, each center link is to be decreased in length by 0.20 inches (5.08 mm).

For pitches other than those used in the example, the wear of each pin 13, each center link 11, and each side link 12 needs to be calculated by the process described above. The amount of compression required to restore the links can then be determined.

Figure 2:
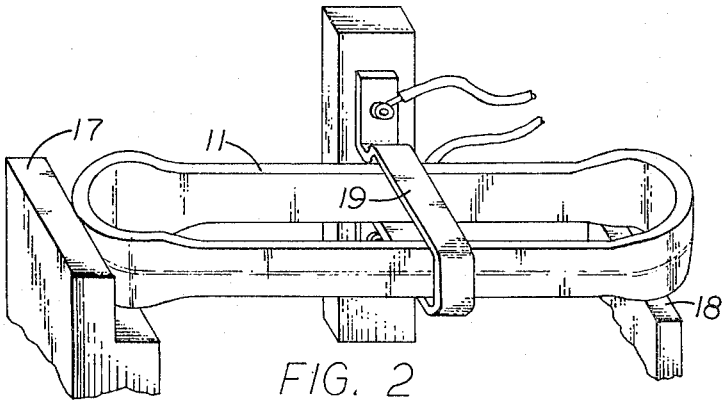
FIG. 2 is a perspective view of a heating means for links of chain.

The first step of the method for decreasing the lengths of the center links 11 is to apply concentrated heat to central portions of both sides of the center links simultaneously. This step is illustrated in FIG. 2 wherein a fixture having a stop 17 and a rest 18 supports a link 11 such that an induction coil 19 is about middle portions of both sides of the link 11. Typically, the portions in the middle of the sides to be heated are each about 0.75 inch (1.9 cm) in length along the respective sides. The heating may be done by various means, but the use of the induction coil is preferable. Typically, alternating current will be applied to the induction coil for 5 seconds and the central cross-sectional areas of the sides of the link 11 will be heated to a maximum temperature between 1100 and 1300 degrees F. (593 and 704 degrees C.)

After the link 11 has been heated until the central portions of the sides are malleable, the link is quickly transferred to a base 19 that has a pair of spaced grooves 21 for receiving respective sides of the link 11. Although the sides of the grooves 21 fit tightly against the sides of the link 11 throughout most of their links, the central portions of the grooves as shown exaggerated at positions 22 are widened and deepened slightly to permit enlargement of the heated portions of the sides of the link 11. A die 20 having grooves 23 similar to the grooves 21 of the base 19 is immediately positioned over the base 19 and the center link 11 to contain the sides of the center link for preventing undesirable distortion of the link while force is applied to the link by the compressing members 15 and 16. The compressing members 15 and 16 are moved inwardly immediately until they are separated an exact calculated distance to decrease the length of the link 11 by the desired amount. The link 11 is then ready to be removed from the base 19, and according to requirements for strength, either the treatment of the link is now complete, or the link may be quenched immediately to restore temper to the portions that were heated.

Figure 3:
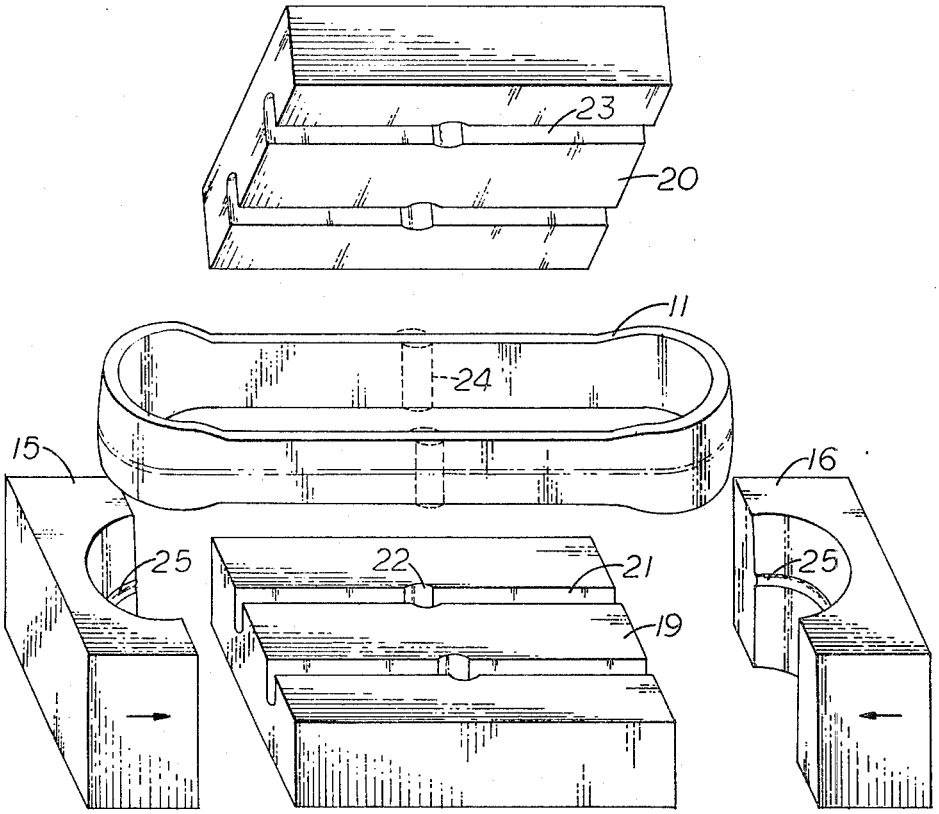
FIG. 3 is a perspective, exploded view of means for compressing worn chain links.

Since for most uses, the strength of the original link is greater than that required, the step for quenching the link is usually unnecessary. The part that has been heated is enlarged slightly as shown at 24 in FIG. 3 and the increased cross-sectional area of the portion that was heated compensates for loss of strength of the metal. As an example of the amount of enlargement to be expected, if the width of a side of a link before reconditioning is 0.34 inch (0.87 cm), then the width can be expected to be increased by 0.008 inch to 0.012 inch (0.02 to 0.03 cm). The central portions of the grooves 21 in the base 19 and the central portions of the grooves 23 in the die 20 would need to be widened this small amount as shown exaggerated at 22. Tests show that the sides of the links that are reconditioned without quenching retain 65 to 95 percent of their tensile strength. Since the heat to the sides is concentrated for a short period, the temperature of the ends of the link 11 never reach a temperature as high as 500 degrees F. (260 degrees C.), and therefore the ends do not lose their temper and their wearing qualities.

Various tools may be used for reconditioning links according to the present method. Precautions must be taken to maintain the shapes of the links. Steel forgings have a flashing about the center, and the center of the contoured surfaces of the compressing members 15 and 16 must be relieved as shown at 25 in FIG. 3 so force is applied beside the flashing where the dimensions of the ends are accurate. To maintain the shape of the link 11 accurately and to obtain exactly the required length, a mandrel may be positioned inside the link 11 before the die 20 is in place in order to bear against the inside surfaces of the ends of the link 11 for determining amount of compression. An alternate fixture for holding the sides of the link 11 might have a space across the center to allow space for the induction coil 19 while the link 11 is in position to be compressed. Usual techniques for obtaining automatic operation may be applied for reconditioning the links 11 quickly with minimum labor.

I claim:

1. The method of reconditioning similar oblong chain links of a worn chain comprising the following steps:

(1) disassembling said worn chain links from said chain for reconditioning said chain links individually, (2) providing a support to hold said chain links individually, positioning one of said chain links to be reconditioned in said support, providing a heating device positioned relative to said support, said heating device being operable to provide intense heat concentrated in designated central opposite portions of said one chain link positioned in said support, (3) operating said heating device to apply heat simultaneously to said central opposite portions of the sides of said one chain link, the application of heat being concentrated over short longitudinal distances of the sides and being of such intensity and short duration to heat said central portions throughout to a required temperature for reforming said portions with moderate longitudinal force while maintaining both ends of said one chain link at a relatively lower temperature to preserve the hardness thereof, (4) providing a compressing member at each end of said one chain link, said compressing members being aligned with said one chain link in a direction to provide longitudinal inward forces within said sides thereof, each of said compressing members having a formed end adjacent a respective end of said one chain link, each of said formed ends contoured to fit precisely said adjacent end of said one chain link, (5) moving at least one of said compressing members inwardly to position said compressing members against said respective ends of said one chain link and continuing to move at least one of said compressing members until said compressing members are separated a predetermined distance to shorten said one chain link while the temperature of said central portions thereof in cross section is substantially maximum, said predetermined distance being just sufficient to restore the pitch of said one chain link.

2. The method of reconditioning chain links according to claim 1 wherein said heating device is an induction coil, the step of operating said heating device includes positioning said induction coil about said one chain link and connecting a source of alternating current to said induction coil.

3. The method of reconditioning chain links according to claim 1 including an additional step of quenching said one chain link immediately after restoration of pitch thereof.

* * * * *